US008982113B2

(12) United States Patent
Kang

(10) Patent No.: US 8,982,113 B2
(45) Date of Patent: Mar. 17, 2015

(54) LCD PANEL AND METHOD FOR CONTROLLING VOLTAGE THEREOF

(75) Inventor: Chih-Tsung Kang, Shenzhen (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 425 days.

(21) Appl. No.: 13/378,672

(22) PCT Filed: Sep. 15, 2011

(86) PCT No.: PCT/CN2011/079702

§ 371 (c)(1),
(2), (4) Date: Dec. 15, 2011

(87) PCT Pub. No.: WO2013/033923

PCT Pub. Date: Mar. 14, 2013

(65) Prior Publication Data

US 2013/0057534 A1 Mar. 7, 2013

(30) Foreign Application Priority Data

Sep. 5, 2011 (CN) ..... 2011 1 0260535

(51) Int. Cl.
*G09G 5/00* (2006.01)
*G09G 3/36* (2006.01)

(52) U.S. Cl.
CPC ..... *G09G 3/36* (2013.01)
USPC ..... 345/212; 345/92; 345/204

(58) Field of Classification Search
CPC ..... G09G 3/3655; G09G 2230/00; G09G 2310/06; G09G 3/3659
USPC ..... 345/87–94, 208–212
See application file for complete search history.

(56) References Cited

U.S. PATENT DOCUMENTS

| | | | | |
|---|---|---|---|---|
| 6,590,552 | B1 * | 7/2003 | Yokoyama et al. | 345/92 |
| 2009/0002351 | A1 * | 1/2009 | Kim | 345/204 |
| 2009/0102820 | A1 * | 4/2009 | Chen et al. | 345/204 |

* cited by examiner

*Primary Examiner* — Alexander Eisen
*Assistant Examiner* — Amit Chatly
(74) *Attorney, Agent, or Firm* — Mark M. Friedman

(57) ABSTRACT

The present invention discloses an LCD panel, which includes a gate driver, a source driver, a plurality of gate lines and data lines. The gate lines and the data lines define a plurality of pixel units, and each pixel unit includes a TFT, a common electrode, and a pixel electrode. The data line is utilized to charge the pixel electrode. The LCD panel further includes a common electrode line, the common electrode line coupled to the common electrode. The common electrode line is utilized to provide alternating common electrode voltages to the common electrode, so that a voltage of the pixel electrode still approaches a target voltage by which the data line charges the pixel electrode when a gate voltage of the TFT is turned off. The present invention also provides a method for controlling voltages of the LCD panel.

8 Claims, 4 Drawing Sheets

LCD PANEL AND METHOD FOR CONTROLLING VOLTAGE THEREOF

FIELD OF THE INVENTION

The present invention relates to a liquid crystal display (LCD) technology, and especially to an LCD panel and a method for controlling a voltage thereof.

BACKGROUND OF THE INVENTION

With a growing popularity of LCDs, quality of the LCDs is also increasing.

Referring to FIG. 1, FIG. 1 is a driving circuit diagram illustrating a liquid crystal display (LCD) panel in the prior art. The LCD panel includes pixel electrodes 101, gate lines 102, data lines 103, pixel capacitors 104, and storage capacitors 105.

After a gate voltage (not shown) of a thin film transistor (TFT) is turned on, an electrical signal is written into the pixel electrode 101 via the data line 103, thereby providing a filled voltage signal for the pixel electrode 101. Then, the gate voltage of the TFT is turned off, and the pixel electrode 101 maintains a constant voltage.

In driving the TFT, the same Vcom is applied to the pixel capacitor 104 and the storage capacitor 105. However, when the gate voltage of the TFT is turned off, the voltage on the gate line 102 is switched from Vg_on to Vg_off. Referring to FIG. 2, the voltage of the pixel electrode 101 is affected by the capacitors to generate a feed-through voltage drop $\Delta Vp$ due to a redistribution of electric charges.

The voltage drop $\Delta Vp$ makes voltages of positive and negative polarities that originally were symmetrical with respect to the Vcom being asymmetrical. The voltage differences generate a flicker when driving using the voltages of the positive and negative polarities, resulting in a crosstalk, affecting the user's viewing.

Therefore, there is a problem of the crosstalk resulting form the nonsymmetrical positive and negative voltages when the gate voltage of the TFT is turned off and the voltage of the pixel electrode jumps. The problem remains to be solved in the LCD technology.

SUMMARY OF THE INVENTION

An objective of the present invention is to provide an LCD panel which can solve the problem of the crosstalk resulting form the nonsymmetrical positive and negative voltages when the gate voltage of the TFT is turned off and the voltage of the pixel electrode jumps.

To achieve the foregoing objective, an LCD panel constructed in the present invention includes: a gate driver, a source driver, a plurality of gate lines and a plurality of data lines. The gate lines and the data lines define a plurality of pixel units, and each pixel unit includes a TFT, a common electrode, and a pixel electrode. The data line is utilized to charge the pixel electrode.

The LCD panel further comprises a common electrode line, the common electrode line coupled to the common electrode. The common electrode line is utilized to alternately provide a first common electrode voltage and a second common electrode voltage to the common electrode, so that the charge voltage of the pixel electrode still approaches a target voltage by which the data line charges the pixel electrode when a gate voltage of the TFT is turned off.

The data line, a gate of TFT, and the common electrode line herein control each of responsive voltages according to sequential order of time points A1, B1, and C1. At the time point A1, the data line is utilized to provide the pixel voltage to the pixel unit. At the time point B1, the gate voltage of the TFT is turned on, and the data line begins to charge the pixel electrode, and the common electrode line is utilized to provide the first common electrode voltage to the common electrode. At the time point C1, the gate voltage of the TFT is turned off, and the common electrode line is utilized to alter the first common electrode voltage into the second common electrode voltage and provide to the common electrode.

To achieve the foregoing objective, an LCD panel further provided in the present invention includes a gate driver, a source driver, a plurality of gate lines and a plurality of data lines. The gate lines and the data lines define a plurality of pixel units, and each pixel unit includes a TFT, a common electrode, and a pixel electrode. The data line is utilized to charge the pixel electrode. The LCD panel further comprises a common electrode line, the common electrode line coupled to the common electrode. The common electrode line is utilized to alternately provide a first common electrode voltage and a second common electrode voltage to the common electrode, so that the charge voltage of the pixel electrode still approaches a target voltage by which the data line charges the pixel electrode when a gate voltage of the TFT is turned off.

The data line, a gate of TFT, and the common electrode line herein control each of responsive voltages according to sequential order of time points A2, B2, C2, and D2. At the time point A2, the data line is utilized to provide the pixel voltage to the pixel unit, and the common electrode line is utilized to provide the first common electrode voltage to the common electrode. At the time point B2, the gate voltage of the TFT is turned on, and the data line begins to charge the pixel electrode. At the time point C2, the gate voltage of the TFT is turned off. At the time point D2, the common electrode line is utilized to alter the first common electrode voltage into the second common electrode voltage and provide to the common electrode.

In the LCD panel of the present invention, the second common electrode voltage is greater than the first common electrode voltage; the first common electrode voltage and the second common electrode voltage are generated alternately in a fixed period of time, which is a duration of scanning a frame.

Another objective of the present invention is to provide an LCD panel which can solve the problem of the crosstalk resulting form the nonsymmetrical positive and negative voltages when the gate voltage of the TFT is turned off and the voltage of the pixel electrode jumps.

To achieve the foregoing objective, an LCD panel constructed in the present invention includes a gate driver, a source driver, a plurality of gate lines and a plurality of data lines. The gate lines and the data lines define a plurality of pixel units, and each pixel unit includes a TFT, a common electrode, and a pixel electrode. The data line is utilized to charge the pixel electrode. The LCD panel further comprises a common electrode line, the common electrode line coupled to the common electrode.

The common electrode line is utilized to provide alternating common electrode voltages to the common electrode, so that the charge voltage of the pixel electrode still approaches a target voltage by which the data line charges the pixel electrode when a gate voltage of the TFT is turned off.

In the LCD panel of the present invention, the common electrode voltages comprises a first common electrode voltage and a second common electrode voltage, and the second common electrode voltage is larger than the first common electrode voltage.

The first common electrode voltage and the second common electrode voltage are generated alternately in a fixed period of time, which is a duration of scanning a frame.

In the LCD panel of the present invention, respective voltages of the data line, a gate of TFT, and the common electrode line are controlled according to time points A1, B1, and C1, which are sequentially separated by intervals.

At the time point A1, the data line is utilized to provide the pixel voltage to the pixel unit.

At the time point B1, the gate voltage of the TFT is turned on, and the data line begins to charge the pixel electrode, and the common electrode line is utilized to provide the first common electrode voltage to the common electrode.

At the time point C1, the gate voltage of the TFT is turned off, and the common electrode line is utilized to alter the first common electrode voltage into the second common electrode voltage and provide to the common electrode.

In the LCD panel of the present invention, respective voltages of the data line, a gate of TFT, and the common electrode line are controlled according to time points A2, B2, C2, and D2, which are sequentially separated by intervals.

At the time point A2, the data line is utilized to provide the pixel voltage to the pixel unit, and the common electrode line is utilized to provide the first common electrode voltage to the common electrode.

At the time point B2, the gate voltage of the TFT is turned on, and the data line begins to charge the pixel electrode.

At the time point C2, the gate voltage of the TFT is turned off.

At the time point D2, the common electrode line is utilized to alter the first common electrode voltage into the second common electrode voltage and provide to the common electrode.

In the LCD panel of the present invention, the data line, the gate of TFT and the common electrode line are controlled according to time points A3, B3, C3, D3, and E3, which are sequentially separated by intervals;

At the time point A3, the data line is utilized to provide the pixel voltage to the pixel unit.

At the time point B3, the gate voltage of the TFT is turned on, and the data line begins to charge the pixel electrode.

At the time point C3, the common electrode line is utilized to provide the first common electrode voltage to the common electrode.

At the time point D3, the gate voltage of the TFT is turned off.

At the time point E3, the common electrode line is utilized to alter the first common electrode voltage into the second common electrode voltage and provide to the common electrode.

Another objective of the present invention is to provide a method for controlling a voltage of an LCD panel, thereby solving the problem of the crosstalk resulting form the nonsymmetrical positive and negative voltages when the gate voltage of the TFT is turned off and the voltage of the pixel electrode jumps.

To achieve the foregoing objective, a method for controlling a voltage of an LCD panel is constructed in the present invention. The LCD panel includes a gate driver, a source driver, a plurality of gate lines and a plurality of data lines. The gate lines and the data lines define a plurality of pixel units, and each pixel unit comprises a TFT, a common electrode, and a pixel electrode. The method includes the steps of: providing a common electrode line for coupling to the common electrode; charging the pixel electrode through the data line; and providing alternating common electrode voltages to the common electrode through the common electrode line, so that the charge voltage of the pixel electrode still approaches a target voltage by which the data line charges the pixel electrode when a gate voltage of the TFT is turned off.

In the method for controlling the voltage of the LCD panel of the present invention, the common electrode voltages comprises a first common electrode voltage and a second common electrode voltage, and the second common electrode voltage is larger than the first common electrode voltage.

The first common electrode voltage and the second common electrode voltage are generated alternately in a fixed period of time, which is a duration of scanning a frame.

In the method for controlling the voltage of the LCD panel of the present invention, respective voltages of the data line, a gate of TFT, and the common electrode line are controlled according to time points A1, B1, and C1, which are sequentially separated by intervals.

At the time point A1, the data line provides the pixel voltage to the pixel unit.

At the time point B1, the gate voltage of the TFT is turned on, and the data line begins to charge the pixel electrode, and the common electrode line begins to provide the first common electrode voltage to the common electrode.

At the time point C1, the gate voltage of the TFT is turned off, and the common electrode line is utilized to alter the first common electrode voltage into the second common electrode voltage and provide to the common electrode.

In the method for controlling the voltage of the LCD panel of the present invention, respective voltages of the data line, a gate of TFT, and the common electrode line are controlled according to time points A2, B2, C2, and D2, which are sequentially separated by intervals.

At the time point A2, the data line provides the pixel voltage to the pixel unit, and the common electrode line begins to provide the first common electrode voltage to the common electrode.

At the time point B2, the gate voltage of the TFT is turned on, and the data line begins to charge the pixel electrode.

At the time point C2, the gate voltage of the TFT is turned off.

At the time point D2, the common electrode line is utilized to alter the first common electrode voltage into the second common electrode voltage and provide to the common electrode.

In the method for controlling the voltage of the LCD panel of the present invention, the data line, a gate of TFT and the common electrode line are controlled according to time points A3, B3, C3, D3, and E3, which are sequentially separated by intervals.

At the time point A3, the data line provides the pixel voltage to the pixel unit.

At the time point B3, the gate voltage of the TFT is turned on, and the data line begins to charge the pixel electrode.

At the time point C3, the common electrode line is utilized to provide the first common electrode voltage to the common electrode.

At the time point D3, the gate voltage of the TFT is turned off.

At the time point E3, the common electrode line is utilized to alter the first common electrode voltage into the second common electrode voltage and provide to the common electrode.

Compared with the prior art, the problem resulting from the nonsymmetrical positive and negative voltages when the gate voltage of the TFT is turned off and the voltage of the pixel electrode jumps is solved, so the flicker of image is reduced and the display quality of the product is improved.

It is to be understood that both the foregoing general description and the following detailed description of the present invention are exemplary and explanatory and are intended to provide further explanation of the invention as claimed.

DETAILED DESCRIPTION OF THE PREFERRED EMBODIMENTS

Descriptions of the following embodiments refer to attached drawings which are utilized to exemplify specific embodiments.

Figure 1:
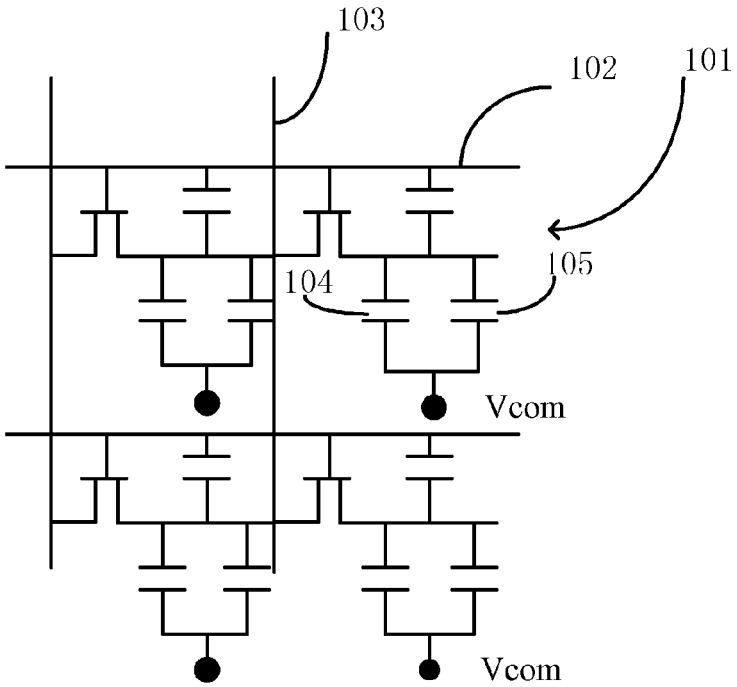
FIG. 1 (Prior Art)
FIG. 1 is a driving circuit diagram illustrating a liquid crystal display in the prior art.
Figure 2:
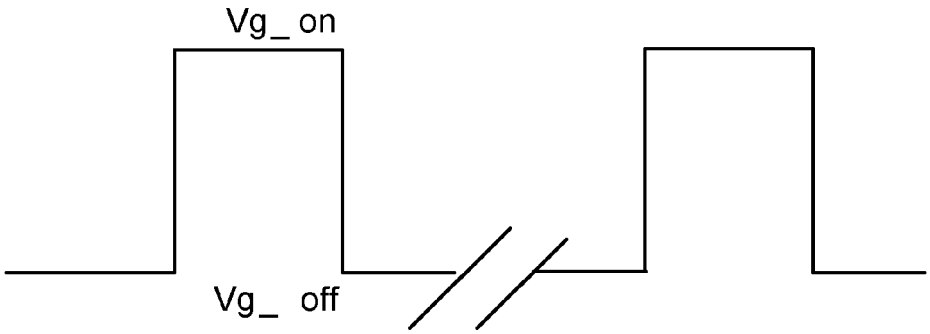
FIG. 2 (Prior Art)
FIG. 2 is a schematic drawing illustrating a voltage change of gate line of the LCD in the prior art.
Figure 3:
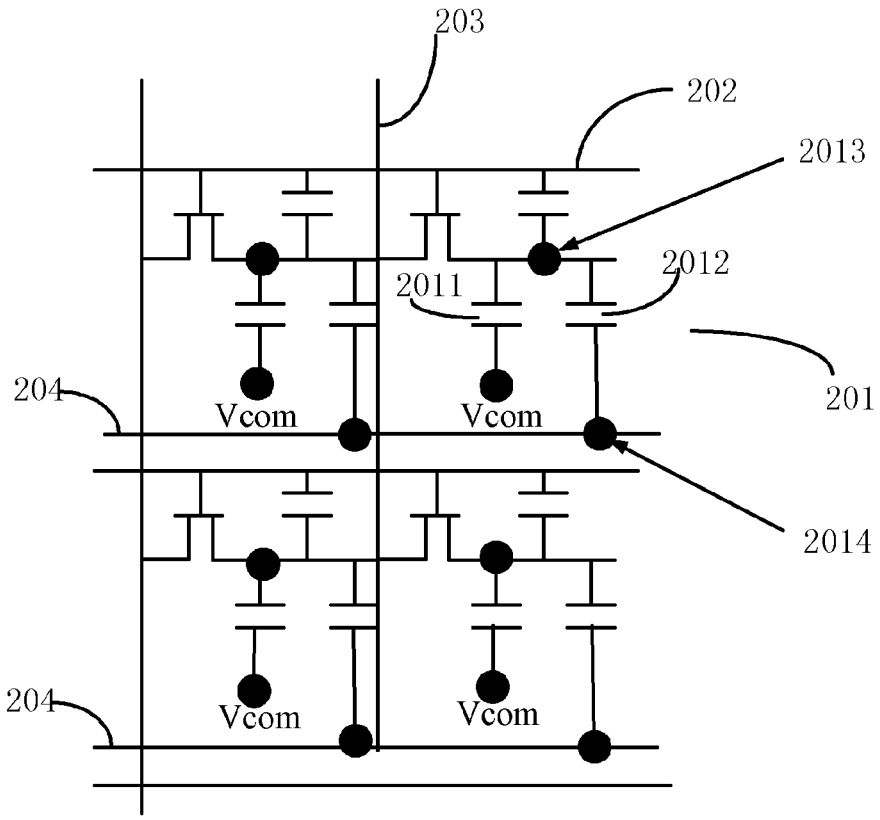
FIG. 3 is a circuit diagram illustrating an LCD panel according to a preferred embodiment of the present invention.

FIG. 3 is a circuit diagram illustrating an LCD panel according to a preferred embodiment of the present invention.

The LCD panel provided by the present invention includes a gate driver, a source driver (not shown), a plurality of gate lines 202 and data lines 203. The gate lines 202 and the data lines 203 define a plurality of pixel units 201. Each of the pixel units 201 includes a pixel capacitor 2011, a storage capacitor 2012, a pixel electrode 2013, and a common electrode 2014.

The LCD panel provided by the present invention further includes a TFT (not shown). TFT includes a gate, a source, and a drain.

The LCD panel provided by the present invention further includes a common electrode line 204, which coupled to the common electrode 2014.

The data line 203 herein is utilized to charge the pixel electrode 2013; also the pixel capacitor 2011 and the storage capacitor 2012 are charged at the same time.

The common electrode line 204 is utilized to provide alternating common electrode voltages to the common electrode 2014 so that a voltage of the pixel electrode 2013 still approaches a target voltage by which the data line 203 charges the pixel electrode 2013 when a gate voltage of the TFT is turned off.

In the present invention, that the voltage of the pixel electrode 2013 still approaches the target voltage by which the data line 203 charges the pixel electrode 2013 indicates that a difference between the target voltage and the voltage of the pixel electrode 2013 after charging is infinitely small or even the same. More specifically, the difference value between the target voltage and the voltage of the pixel electrode 2013 after charging is within a preset threshold range, such as 0.01V to 0.03V.

Preferably, the alternating common electrode voltages comprise a first common electrode voltage Vcom_T1 and a second common electrode voltage Vcom_T2. The first common electrode voltage Vcom_T1 is smaller than the second common electrode voltage Vcom_T2.

The first common electrode voltage Vcom_T1 and the second common electrode voltage Vcom_T2 are generated alternately in a fixed period of time, which is a duration of scanning a frame. The turn-on duration T1 corresponds to the first common electrode voltage Vcom_T1, and the turn-off duration T2 corresponds into the second common electrode voltage Vcom_T2.

Figure 4:
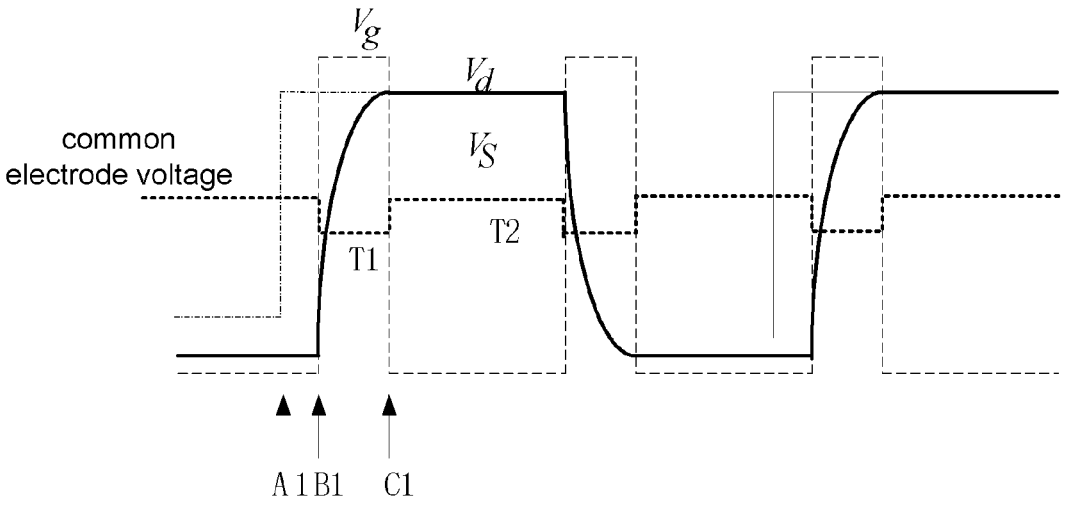
FIG. 4 is a schematic drawing illustrating waveform of the LCD panel according to a first preferred embodiment of the present invention.

FIG. 4 is a schematic drawing illustrating waveform of the LCD panel according to a first preferred embodiment of the present invention.

Referring to FIG. 3 and FIG. 4, in the embodiment shown in FIG. 4, respective voltages of the data line 203, the gate of TFT, and the common electrode line 204 are controlled according to sequential order of time points A1, B1, and C1, which are sequentially separated by intervals.

The time point A1 at which the data line 203 provides the pixel voltage to the pixel unit 201 is earlier than the time point B1 at which the gate voltage Vg of the TFT is turned on.

At the time point B1, the gate voltage Vg of the TFT is turned on; meanwhile, the common electrode line 204 provides the first common electrode voltage Vcom_T1 to the common electrode 2014, and the data line 203 begins to charge the pixel electrode 2013 at the same time. The target voltage of the data line 203 charging the pixel electrode 2013 is Vd. After charging, the voltage of the pixel electrode 2013 is Vs, in which Vs=Vd. A voltage difference between the pixel electrode 2013 and the common electrode 2014 is Vd−Vcom_T1. The electric charges between the pixel electrode 2013 and the common electrode 2014 indicate Q=C1*(Vs−Vcom_T1).

At the time point C1, the gate voltage of the TFT is turned off, and the common electrode line 204 provides the second common electrode voltage Vcom_T2 to the common electrode 2014. In accordance a charge conservation general principle as follow:

C1*(Vs−Vcom_T1)=C1*(V's−Vcom_T2), because Vcom_T2>Vcom_T1, V's>Vs. Meanwhile, when the gate voltage Vg of the TFT is turned off, the voltage V's of the pixel electrode 2013 which is affected by the capacitor has a voltage drop ΔV such that the voltage of the pixel electrode 2013 becomes V's−ΔV. Due to V's>V's−ΔV>Vs=Vd, the final voltage V's−ΔV of the pixel electrode 2013 compared to V's is closer to the target voltage Vd by which the data line 203 charges the pixel electrode 2013.

Figure 5:
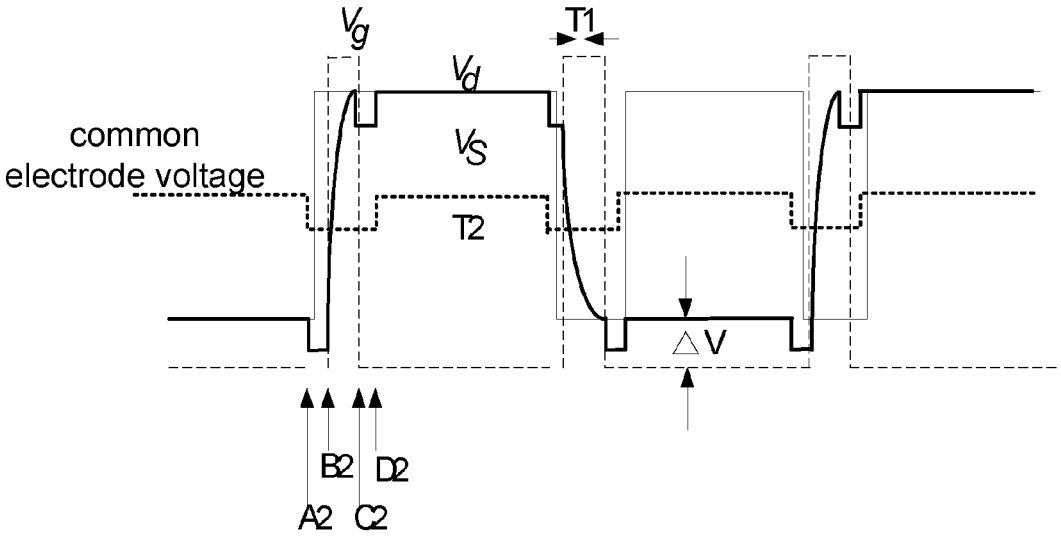
FIG. 5 is a schematic drawing illustrating waveform of the LCD panel according to a second preferred embodiment of the present invention.

Referring to FIG. 5, FIG. 5 is a schematic drawing illustrating waveform of the LCD panel according to a second preferred embodiment of the present invention.

Referring to FIG. 3 and FIG. 5, in the embodiment shown in FIG. 5, respective voltages of the data line 203 a gate of TFT and the common electrode line 204 are controlled according to sequential order of time points A2, B2, C2, and D2, which are sequentially separated by intervals.

The time point A2 at which the data line 203 provides the pixel voltage to the pixel unit 201 is earlier than the time point B2 at which the gate voltage Vg of the TFT is turned on.

At the time point A2, the gate voltage Vg of the TFT is not turned on, and the common electrode line 204 alters the voltage of the common electrode 2014 to the first common electrode voltage Vcom_T1. In accordance with charge conservation:

$$C1*(Vcom_T2-Vs)=C1*(Vcom_T1-V's),\ \text{because}\ Vcom_T2>Vcom_T1,\ Vs>V's.$$

At the time point B2, the gate voltage of the TFT is turned on, and the data line 203 begins to charge the pixel electrode 2013. The target voltage of the data line 203 charging the pixel electrode 2013 is Vd. After charging, the voltage of the pixel electrode 2013 is Vs, in which Vs=Vd. A voltage difference between the pixel electrode 2013 and the storage capacitor 2012 is Vs−Vcom_T1. The electric charges between the pixel electrode 2013 and the common electrode 2014 indicate Q=C1*(Vs−Vcom_T1).

At the time point C2, the gate voltage of the TFT is turned off, and the voltage of the common electrode 2014 maintains the first common electrode voltage Vcom_T1. Meanwhile, the electric charges between the pixel electrode 2013 and the common electrode 2014 still indicate C1*(Vs−Vcom_T1).

However, the voltage Vs of the pixel electrode 2013 has a voltage drop ΔV such that the voltage of the pixel electrode 2013 becomes Vs−ΔV.

At the time point D2, the common electrode line 204 alters the voltage of the common electrode into the second common electrode voltage Vcom_T2. In accordance with charge conservation:

Q=C1*(Vs−ΔV−Vcom_T1)=C1*(V's−Vcom_T2), because Vcom_T2>Vcom_T1, V's>Vs−ΔV. Due to V's>V's−ΔV, and Vs=Vd>Vs−ΔV, the final voltage V's of the pixel electrode 2013 is closer to the target voltage Vd by which the data line 203 charges the pixel electrode 2013.

Figure 6:
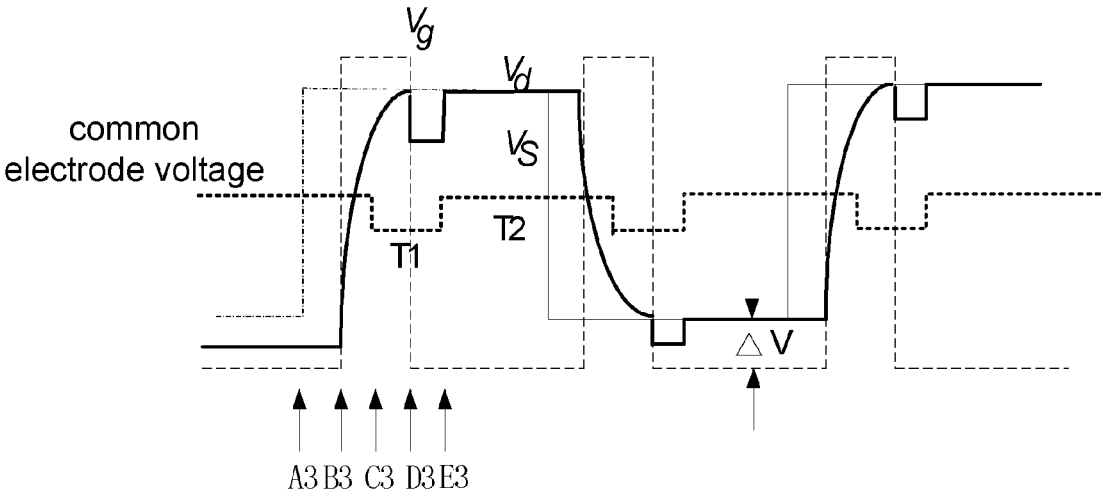
FIG. 6 is a schematic drawing illustrating waveform of the LCD panel according to a third preferred embodiment of the present invention.

Referring to FIG. 6, FIG. 6 is a schematic drawing illustrating waveform of the LCD panel according to a third preferred embodiment of the present invention.

Referring to FIG. 3 and FIG. 6, in the embodiment shown in FIG. 6, respective voltages of the data line 203, the gate of TFT and the common electrode line 204 are controlled according to sequential order of time points A3, B3, C3, D3, and E3, which are sequentially separated by intervals.

The time point A3 at which the data line 203 provides the pixel voltage to the pixel unit is earlier than the time point B3 at which the gate voltage Vg of the TFT is turned on.

At the time point B3, the gate voltage of the TFT is turned on, and the data line 203 begins to charge the pixel electrode 2013. The target voltage of the data line 203 charging the pixel electrode 2013 is Vd. After charging, the voltage of the pixel electrode 2013 is Vs, in which Vs=Vd. A voltage difference between the pixel electrode 2013 and the common electrode 2014 is Vd−Vcom_T2. The electric charges between the pixel electrode 2013 and the common electrode 2014 indicate:

$$Q=C1*(Vs-V\text{com}_T2).$$

At the time point C3, the common electrode line 204 alters the second common electrode voltage Vcom_T2 to the first common electrode voltage Vcom_T1. The data line 203 continuous charging the pixel electrode 2013 at the same time. After charging, the voltage of the pixel electrode 2013 is still Vs=Vd. A voltage difference between the pixel electrode 2013 and the common electrode 2014 is Vd−Vcom_T1. The electric charges between the pixel electrode 2013 and the common electrode 2014 indicate:

$$Q=C1*(Vs-V\text{com}_T1).$$

At the time point D3, the gate voltage of the TFT is turned off, and the data line 203 stops charging the pixel electrode 2013. Under this condition, when the gate voltage Vg of the TFT is turned off, the voltage Vs of the pixel electrode 2013 has a voltage drop ΔV such that the voltage of the pixel electrode 2013 becomes Vs−ΔV. The electric charges in the pixel electrode 2013 comply with C 1*(Vs−ΔV−Vcom_T1).

At the time point E3, the common electrode line 204 alters the first common electrode voltage Vcom_T1 into the second common electrode voltage Vcom_T2. In accordance with charge conservation, the electric charges in the pixel electrode 2013 comply with C1*(Vs−ΔV−Vcom_T1)=C1*(V's−Vcom_T2).

Because Vcom_T2>Vcom_T1, V's>Vs−ΔV. Due to V's>Vs−ΔV, and Vs=Vd>Vs−ΔV, the final voltage V's of the pixel electrode 2013 is closer to the target voltage Vd by which the data line 203 charges the pixel electrode 2013.

In the present invention, the voltages of the positive and negative polarities are more symmetrical. The problem of the crosstalk resulting form the nonsymmetrical positive and negative voltages when the gate voltage of the TFT is turned off and the voltage of the pixel electrode jumps has been effectively solved in the present invention.

Figure 7:
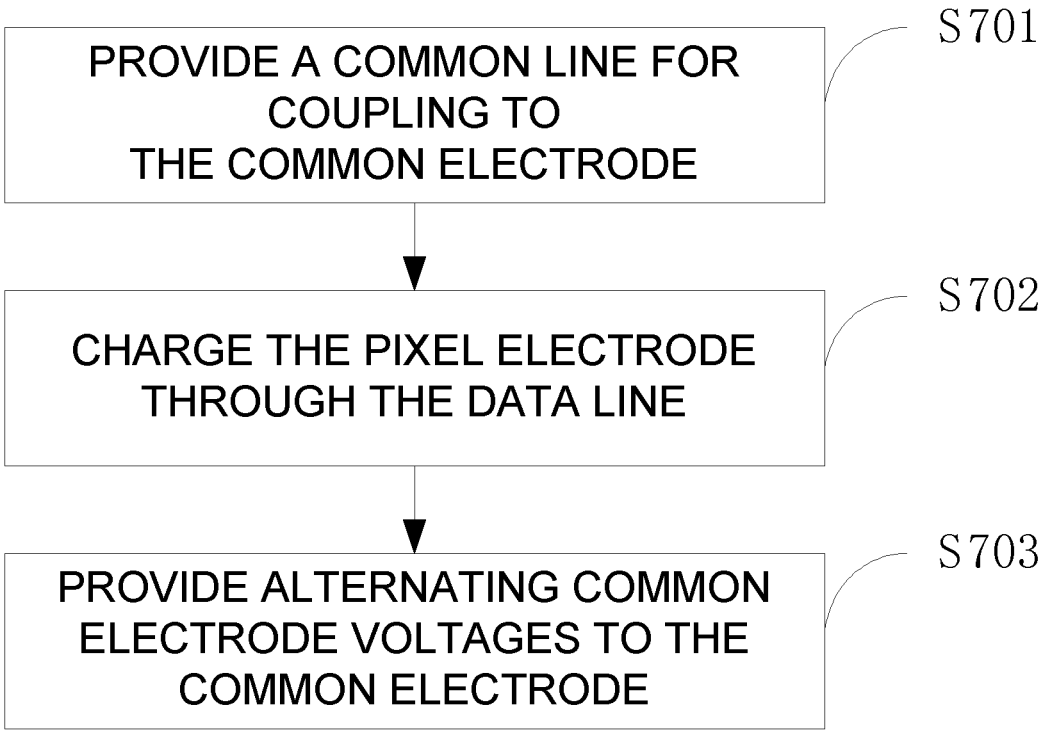
FIG. 7 is a flow chart illustrating a method for controlling the voltage of the LCD panel according to a preferred embodiment of the present invention.

Referring to FIG. 7, a method for controlling the voltage of the LCD panel is provided in the present invention.

At step S701, a common electrode line 204 is provided, and the common electrode line 204 is coupled to the common electrode.

At step S702, the data line 203 charges the pixel electrode 2013.

At step S703, the common electrode line 204 provides alternating common electrode voltages to the common electrode 2014, so that a voltage of the pixel electrode 2013 still approaches a target voltage by which the data line charges the pixel electrode 2013 when a gate voltage of the TFT is turned off.

The LCD panel herein includes a gate driver, a source driver, a plurality of gate lines and a plurality of data lines. The gate lines and the data lines define a plurality of pixel units 201, and each pixel unit 201 comprises a TFT, a common electrode 2014, and a pixel electrode 2013.

Specifically, the common electrode voltages comprise a first common electrode voltage and a second common electrode voltage, and the second common electrode voltage is larger than the first common electrode voltage. The first common electrode voltage and the second common electrode voltage are generated alternately in a fixed period of time, which is a duration of scanning a frame.

Referring to FIG. 4 and FIG. 7, respective voltages of the data line, a gate of TFT, and the common electrode line are controlled according to sequential order of preset time points A1, B1, and C1, which are sequentially separated by interval.

At the time point A1, the data line 203 provides the pixel voltage to the pixel unit 201.

At the time point B1, the gate voltage of the TFT is turned on, and the data line 203 begins to charge the pixel electrode 2013. The common electrode line 204 provides the first common electrode voltage to the common electrode 2014.

At the time point C1, the gate voltage of the TFT is turned off, the common electrode line 204 provides the second common electrode voltage to the common electrode 2014.

Referring to FIG. 5 and FIG. 7, respective voltages of the data line, a gate of TFT, and the common electrode line are controlled according to sequential order of preset time points A2, B2, C2, and D2, which are sequentially separated by interval.

At the time point A2, the data line 203 provides the pixel voltage to the pixel unit 201, and the common electrode line 204 alters the second common electrode voltage to the first common electrode voltage.

At the time point B2, the gate voltage of the TFT is turned on, and the data line 203 begins to charge the pixel electrode 2013.

At the time point C2, the gate voltage of the TFT is turned off.

At the time point D2, the common electrode line 204 is utilized to alter the first common electrode voltage into the second common electrode voltage and provide to the common electrode 2014.

Referring to FIG. 6 and FIG. 7, the data line, a gate of TFT and the common electrode line control each of responsive voltages according to sequential order of preset time points A3, B3, C3, D3, and E3.

At the time point A3, the data line 203 provides the pixel voltage to the pixel unit 201.

At the time point B3, the gate voltage of the TFT is turned on, and the data line 203 begins to charge the pixel electrode 2013.

At the time point C3, the common electrode line 204 alters the second common electrode voltage to the first common electrode voltage and provide to the common electrode 2014.

At the time point D3, the gate voltage of the TFT is turned off.

At the time point E3, the common electrode line 204 is utilized to alter the first common electrode voltage into the second common electrode voltage and provide to the common electrode 2014.

While the preferred embodiments of the present invention have been illustrated and described in detail, various modifications and alterations can be made by persons skilled in this art. The embodiment of the present invention is therefore described in an illustrative but not restrictive sense. It is intended that the present invention should not be limited to the particular forms as illustrated, and that all modifications and alterations which maintain the spirit and realm of the present invention are within the scope as defined in the appended claims.

What is claimed is:

1. An LCD panel, comprising a gate driver, a source driver, a plurality of gate lines and a plurality of data lines, the gate lines and the data lines defining a plurality of pixel units, each pixel unit comprising a TFT, a common electrode, and a pixel electrode, the data line utilized to charge the pixel electrode, characterized in that:

the LCD panel further comprises a common electrode line, the common electrode line coupled to the common electrode;

the common electrode line is utilized to alternately provide a first common electrode voltage and a second common electrode voltage to the common electrode, so that the charge voltage of the pixel electrode still approaches a target voltage by which the data line charges the pixel electrode when a gate voltage of the TFT is turned off; and wherein respective voltages of the data line, a gate of TFT, and the common electrode line are controlled according to time points A2, B2, C2, and D2, which are sequentially separated by intervals; at the time point A2, the data line is utilized to provide the pixel voltage to the pixel unit, and the common electrode line is utilized to provide the first common electrode voltage to the common electrode; at the time point B2, the gate voltage of the TFT is turned on, and the data line begins to charge the pixel electrode; at the time point C2, the gate voltage of the TFT is turned off; at the time point D2, the common on, and the data line begins to charge the pixel electrode; at the time point C2, the gate voltage of the TFT is turned off; at the time point D2, the common electrode line is utilized to alter the first common electrode voltage into the second common electrode voltage and provide to the common electrode; and wherein the alternation from the first common electrode voltage to the second common electrode voltage is near the turn-off of the gate voltage of the TFT and during the data line providing the pixel voltage to the pixel unit before the pixel voltage changing, so that the charge voltage of the pixel electrode still approaches the target voltage before the pixel voltage changing.

2. The LCD panel according to claim 1, characterized in that the second common electrode voltage is greater than the first common electrode voltage; the first common electrode voltage and the second common electrode voltage are generated alternately in a fixed period of time, which is a duration of scanning a frame.

3. An LCD panel, comprising a gate driver, a source driver, a plurality of gate lines and a plurality of data lines, the gate lines and the data lines defining a plurality of pixel units, each pixel unit comprising a TFT, a common electrode, and a pixel electrode, the data line utilized to charge the pixel electrode, characterized in that:

the LCD panel further comprises common electrode lines, the common electrode lines coupled to the common electrodes;

the common electrode line is utilized to provide alternating common electrode voltages to the common electrode, so that the charge voltage of the pixel electrode still approaches a target voltage by which the data line charges the pixel electrode when a gate voltage of the TFT is turned off;

wherein the alternation from the first common electrode voltage to the second common electrode voltage is near the turn-off of the gate voltage of the TFT and during the data line providing the pixel voltage to the pixel unit before the pixel voltage changing, so that the charge voltage of the pixel electrode still approaches the target voltage before the pixel voltage changing.

4. The LCD panel according to claim 3, characterized in that the common electrode voltages comprises a first common electrode voltage and a second common electrode voltage, and the second common electrode voltage is larger than the first common electrode voltage;

the first common electrode voltage and the second common electrode voltage are generated alternately in a fixed period of time, which is a duration of scanning a frame.

5. The LCD panel according to claim 4, characterized in that respective voltages of the data line, a gate of TFT, and the common electrode line are controlled according to time points A2, 32, C2, and D2, which are sequentially separated by intervals;

at the time point A2, the data line is utilized to provide the pixel voltage to the pixel unit, and the common electrode line is utilized to provide the first common electrode voltage to the common electrode;

at the time point B2, the gate voltage of the TFT is turned on, and the data line begins to charge the pixel electrode;

at the time point C2, the gate voltage of the TFT is turned off;

at the time point D2, the common electrode line is utilized to alter the first common electrode voltage into the second common electrode voltage and provide to the common electrode.

6. A method for controlling a voltage of an LCD panel, the LCD panel comprising a gate driver, a source driver, a plurality of gate lines and a plurality of data lines, the gate lines and the data lines defining a plurality of pixel units, each pixel unit comprising a TFT, a common electrode, and a pixel electrode, characterized in that the method comprises the steps of:

providing a common electrode line for coupling to the common electrode;

charging the pixel electrode through the data line; and providing alternating common electrode voltages to the common electrode through the common electrode line, so that a voltage of the pixel electrode still approaches a target voltage by which the data line charges the pixel electrode when a gate voltage of the TFT is turned off;

wherein the alternation from the first common electrode voltage to the second common electrode voltage is near the turn-off of the gate voltage of the TFT and during the data line providing the pixel voltage to the pixel unit before the pixel voltage changing, so that the charge voltage of the pixel electrode still approaches the target voltage before the pixel voltage changing.

7. The method for controlling the voltage of the LCD panel according to claim 6, characterized in that the common electrode voltages comprises a first common electrode voltage and a second common electrode voltage, and the second common electrode voltage is larger than the first common electrode voltage;

the first common electrode voltage and the second common electrode voltage are alternately generated in a fixed period of time, which is a duration of scanning a frame.

8. The method for controlling the voltage of the LCD panel according to claim 7, characterized in that the data line, a gate of TFT, and the common electrode line are controlled according to time points A2, B2, C2, and D2, which are sequentially separated by intervals;

at the time point A2, the data line provides the pixel voltage to the pixel unit, and the common electrode line begins to provide the first common electrode voltage to the common electrode;

at the time point B2, the gate voltage of the TFT is turned on, and the data line begins to charge the pixel electrode;

at the time point C2, the gate voltage of the TFT is turned off;

at the time point D2, the common electrode line is utilized to alter the first common electrode voltage into the second common electrode voltage and provide to the common electrode.

* * * * *

UNITED STATES PATENT AND TRADEMARK OFFICE

CERTIFICATE OF CORRECTION

PATENT NO. : 8,982,113 B2
APPLICATION NO. : 13/378672
DATED : March 17, 2015
INVENTOR(S) : Chih-Tsung Kang It is certified that error appears in the above-identified patent and that said Letters Patent is hereby corrected as shown below:

In the Claims

Column 10:

Line 50 should be corrected as follows:
Change:

-- 32 --
to
"B2"

Signed and Sealed this
Twenty-third Day of June, 2015

Michelle K. Lee

Michelle K. Lee
*Director of the United States Patent and Trademark Office*